US008382492B2

(12) United States Patent
Hering et al.

(10) Patent No.: US 8,382,492 B2
(45) Date of Patent: Feb. 26, 2013

(54) MAINS CONNECTION OF A DOMESTIC APPLIANCE

(75) Inventors: Reinhard Hering, Holzheim (DE); Stephan Lutz, Sontheim (DE); Bruno Reiter, Kösingen (DE); Michael Rosenbauer, Reimlingen (DE); Martin Stickel, Giengen/Brenz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 110 days.

(21) Appl. No.: 12/743,378

(22) PCT Filed: Oct. 29, 2008

(86) PCT No.: PCT/EP2008/064647

§ 371 (c)(1),
(2), (4) Date: May 18, 2010

(87) PCT Pub. No.: WO2009/068400

PCT Pub. Date: Jun. 4, 2009

(65) Prior Publication Data

US 2010/0267268 A1 Oct. 21, 2010

(30) Foreign Application Priority Data

Nov. 28, 2007 (DE) ..... 10 2007 057 334

(51) Int. Cl.
*H01R 13/648* (2006.01)

(52) U.S. Cl. ..... 439/101; 439/924.1

(58) Field of Classification Search ..... 439/924.1, 439/101, 680, 660, 568, 106
See application file for complete search history.

(56) References Cited

U.S. PATENT DOCUMENTS

| | | | | |
|---|---|---|---|---|
| 5,049,092 | A * | 9/1991 | Takano et al. | 439/540.1 |
| 6,200,155 | B1 * | 3/2001 | Chudkosky et al. | 439/371 |
| 6,241,551 | B1 * | 6/2001 | Watanabe | 439/557 |
| 6,492,591 | B1 * | 12/2002 | Metcalf | 174/53 |
| 6,855,881 | B2 * | 2/2005 | Khoshnood | 174/15.1 |
| 6,918,782 | B2 * | 7/2005 | Foster | 439/352 |
| 7,509,824 | B2 * | 3/2009 | Park et al. | 68/12.23 |
| 2009/0165833 | A1 | 7/2009 | Rehm et al. | |

FOREIGN PATENT DOCUMENTS

| | | | |
|---|---|---|---|
| DE | 3902471 | A1 | 8/1990 |
| DE | 29913501 | U1 | 1/2000 |
| DE | 10112118 | A1 | 10/2002 |
| DE | 102005040241 | A1 | 3/2007 |
| EP | 0452688 | A1 | 10/1991 |
| EP | 1045266 | A2 | 10/2000 |
| EP | 1640824 | A1 | 3/2006 |

* cited by examiner

*Primary Examiner* — Tulsidas C Patel
*Assistant Examiner* — Phuongchi Nguyen
(74) *Attorney, Agent, or Firm* — James E. Howard; Andre Pallapies

(57) ABSTRACT

A domestic appliance that includes at least one mains connection for the supply of power to the domestic appliance from a building supply mains. In an exemplary embodiment of the invention, the mains connection may include data transfer contacts.

22 Claims, 2 Drawing Sheets

MAINS CONNECTION OF A DOMESTIC APPLIANCE

BACKGROUND OF THE INVENTION

The invention relates to a domestic appliance comprising at least one mains connection for enabling electrical energy to be supplied from a domestic mains power supply.

Domestic appliances are employed for dealing with household chores such as cooking, baking, washing and cleaning, for example, and require electrical energy for their operation. In order to be supplied with electrical energy, domestic appliances of the aforesaid type have an electrical mains connection which permits an electrical connection to be established to a domestic mains power supply for the purpose of supplying electrical loads with electrical energy.

In this case the domestic appliances can be large appliances or household appliances such as refrigerators, electric cooking ranges, laundry dryers, for example, or water-conducting domestic appliances such as washing machines or dishwashers. Furthermore, the domestic appliances may be small appliances such as, for example, small thermal appliances like toasters, hairdryers, microwave ovens or coffee machines, as well as small motor-driven appliances such as, for example, hand mixers, blenders or handheld vacuum cleaners, etc.

In particular in the case of freestanding domestic appliances or large appliances, but also in the case of small appliances, operation is controlled by means of a controller which ensures a sequential execution of a predefined program sequence, in the case of a water-conducting domestic appliance such as a dishwasher or a washing machine, for example, a program sequence chosen from a multiplicity of possible programs and having a multiplicity of individual program steps. Programs of this type which comprise a plurality of program steps, but also other control software, are loaded onto the domestic appliance during manufacture and stored there.

BRIEF SUMMARY OF THE INVENTION

It is therefore the object of the invention to develop domestic appliances in such a way that the loading of programs is made easier.

The invention proceeds on the basis of a domestic appliance comprising at least one mains connection for enabling electrical energy to be supplied from a domestic mains power supply.

The object of the invention is achieved by means of a domestic appliance which has a mains connection that enables electrical energy to be supplied and in addition has data transmission contacts. This results in a particularly simple layout, since only one mains connection is provided and needs to be contacted on the domestic appliance side, and this can then be used universally both for supplying the domestic appliance with electrical energy and for data communication purposes. At the same time loading programs is simplified, since only one connection needs to be established to the mains connection during manufacture. In this case it can be provided that the data communication can take place alternatively to the process of supplying electrical energy or simultaneously to the process of supplying electrical energy. This is also advantageous when, for example, a service engineer connects a diagnostic device via the mains connection for the electrical energy supply and the data transmission contacts, with the result that a reliable electrical supply with electrical energy is ensured via the diagnostic device and at the same time an automated diagnosis is made possible via the data transmission contacts.

The mains connection can be a multi-phase appliance connector, for example a three-phase appliance connector, as used for example for electric cooking ranges. Preferably, however, it is provided that the mains connection is embodied as an appliance connector, for example as a single-phase appliance connector having three projecting mains connection contacts, embodied as contact blades, for the phase, the neutral conductor and the protective ground conductor. In the case of a three-phase mains connection, four or five contact blades disposed in a freestanding arrangement can be provided. In this case the contact blades are arranged centrally in a socket and are completely enclosed by the appliance connector, as is known for example from inlet connectors for non-heating as well as heat-generating appliances.

In this case the mains connection for enabling electrical energy to be supplied is preferably embodied for electrical voltage levels of domestic mains power supplies for supplying electrical energy. These can be mains voltages with alternating voltages of 240 or 230 volts or 127 or 110 volts having the variation ranges that are typical in mains supply networks, e.g. 5% or 10%.

Furthermore it is preferably provided that the data transmission contacts are designed for low electrical voltages. This ensures that the data transmission contacts carry a voltage that represents no hazard to installation personnel, which means that in this case a recessed arrangement of live contacts is not necessary.

The domestic appliance preferably has a controller for operating sequence control which is connected in an electrically conductive manner to the data transmission contacts. By this means the data transmission contacts permit both the transfer of, for example, program data for sequence control into the controller of the domestic appliance during the manufacture of a domestic appliance, i.e. to allow preprogramming of the controller. In addition to a unidirectional data transfer, however, the data transmission contacts can also permit a bidirectional data transfer, which then allows, for example, service personnel to connect a diagnostic device by means of which on the one hand control signals or queries of a domestic appliance can be transmitted via the data transmission contacts, while on the other hand data relating to fault messages or functional queries can be transmitted to the diagnostic device via the data transmission contacts.

The data transmission contacts can be arranged in the middle of the mains connection, e.g. embodied as contact pins. Preferably, however, it is provided that the data transmission contacts are arranged on an inner surface of the mains connection. This arrangement permits socket-side recesses into which the data transmission contacts embodied as contact pins are inserted to be dispensed with when a connection is made to a domestic mains power supply.

Furthermore it is preferably provided that the data transmission contacts extend into an opening of the mains connection. In this case it is preferably provided that the controller, in particular a board of the controller, extends at least in sections into the opening. This permits a particularly compact layout without additional connecting leads. Toward that end it is preferably provided that the board of the controller forms an inner surface of the mains connection, at least in sections. In this way a section of the board seals the opening of the mains connection. A particularly compact layout is made possible if the data transmission contacts are arranged on the board of the controller. The data transmission contacts form a section of the inner wall of the mains connection, which inner wall comes into contact with a corresponding outside surface of a corresponding appliance connection socket and thus establishes a reliable connection which also cannot become disengaged unintentionally due to vibrations and oscillations occurring during the operation of the domestic appliance.

Preferably the domestic appliance, in particular a large appliance or a freestanding domestic appliance, has a plinth return into which a door by means of which a treatment space can be opened, in the case of a dishwasher, for example, is moved for opening same. In this case it is preferably provided that the mains connection is arranged in the region of the plinth return. With this arrangement the mains connection is disposed in particular on the front side, i.e. in a region that is accessible and visible to an operator. Alternatively to this the mains connection can also be arranged on the rear side.

If a permanent connection with wiring in a connection socket is necessary, e.g. in order to comply with national regulations, before the domestic appliance, in particular a freestanding domestic appliance, is placed into operation for the first time, it can preferably be provided that in order to simplify the installation the domestic appliance has an appliance connection socket corresponding to the mains connection and having a terminal block for establishing an electrically conductive connection to a mains connection lead. In this case a strain relief can be provided in addition.

Preferably it is provided that the mains connection and the appliance connection socket are detachably connected to each other, so that a separation of the connection is possible without difficulty for installation or repair purposes. For this purpose it is preferably provided that a snap-in connection securing the connection between the mains connection and the appliance connection socket is provided. Preferably the snap-in connection is embodied so that it can be engaged and/or released without the use of tools.

BRIEF DESCRIPTION OF THE DRAWINGS

The invention is explained below with reference to a drawing, in which.

DETAILED DESCRIPTION OF EXEMPLARY EMBODIMENTS OF THE PRESENT INVENTION

Figure 1:
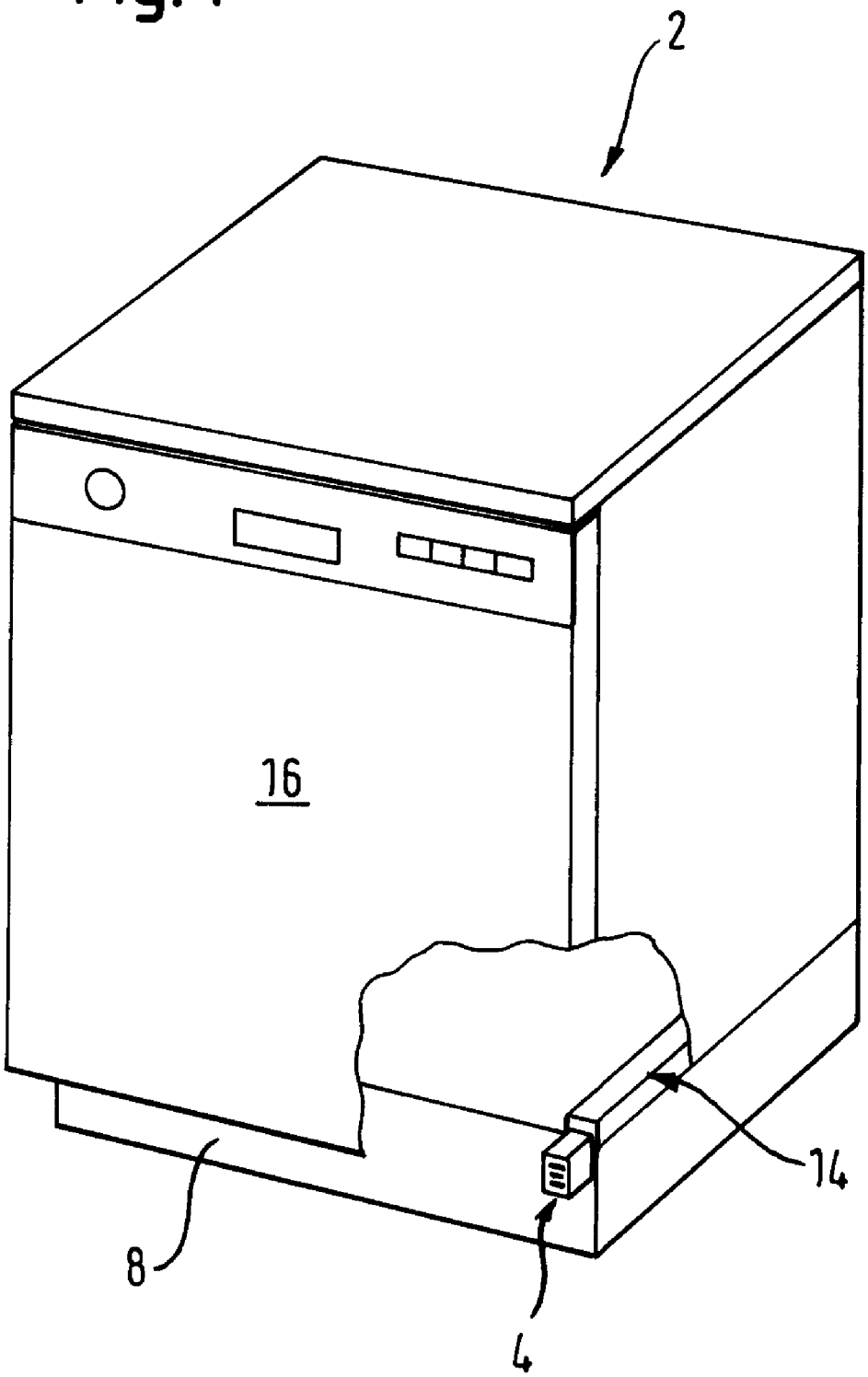
FIG. 1 shows a perspective view of a domestic appliance according to the invention.
Figure 2:
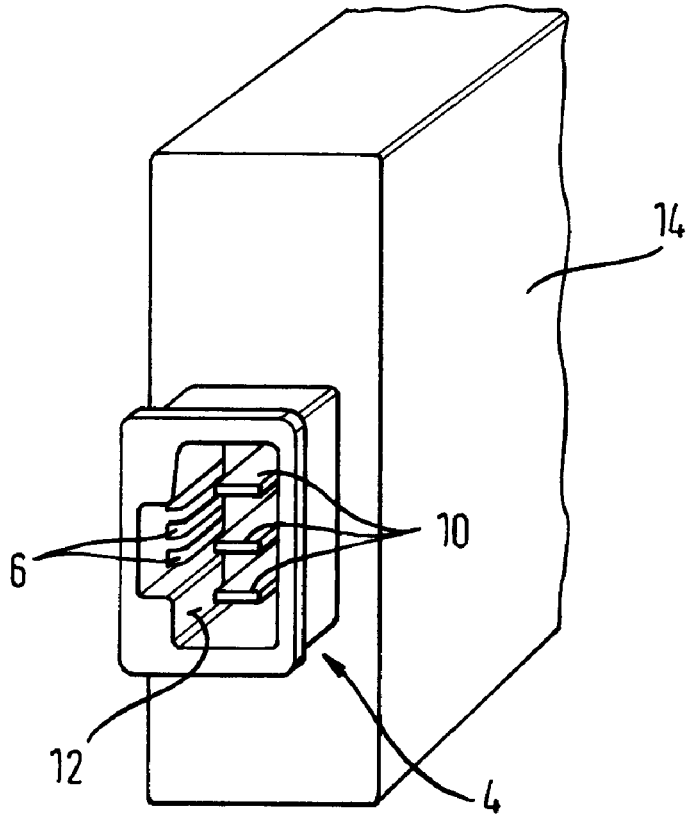
FIG. 2 shows a schematic representation of a mains connection for a domestic appliance.
Figure 3:
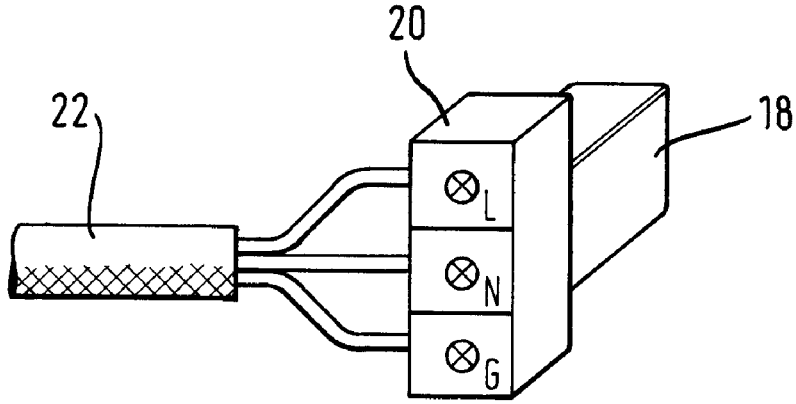
FIG. 3 shows a mains connection lead having an appliance connection socket and a terminal block.

Reference is made to FIGS. 1 to 3.

A dishwasher 2 is shown which has a door 16 which can be opened in order to give access to a treatment space (not shown) in which articles to be washed, i.e. dishes in need of cleaning, can be placed. When the door is opened it pivots with a lower section into a free space which is formed by means of a plinth return 8.

The mains connection 4 for supplying the domestic appliance with electrical energy is arranged in the region of the plinth return 8. In this case it is arranged on the front side of the domestic appliance 2, i.e. at the side that is easily accessible to an operator. In this case the domestic appliance 2 is arranged in the installed state with its rear side against a wall and flanked on either side by kitchen furniture and other appliances.

In order to perform cleaning programs which comprise a plurality of program steps, the domestic appliance 2 has a controller which has, for example, microprocessors and memory (not shown) and is electrically connected to a plurality of actuators, such as pumps or detergent dispensing devices, for example, as well as to the heater of the domestic appliance 2 in order to enable a desired program sequence to be performed by selective control. The controller 14 also has a mains adapter (not shown) for converting the line voltage to an internal voltage value.

The mains connection 4 is embodied as an A.C. power connector and has three contact blades 10 disposed in a freestanding arrangement, to which phase, neutral conductor and protective ground conductor are assigned respectively and by means of which a mains connection is possible to a domestic mains power supply for the purpose of supplying the domestic appliance 2 with electrical energy. In addition the mains connection 4 has data transmission contacts 6 which are arranged on an inner surface 12 of the mains connection 4. In this case the data transmission contacts 6 are not freestanding, but are arranged integrated in the inner surface such that an appliance connection socket can be introduced into the mains connection 4 and this will not be impeded by the data transmission contacts 6. In this way it is possible to connect the domestic appliance 2 in a known manner to a domestic mains power supply for the purpose of supplying electrical energy by means of a mains connection. In this case the transmission contacts themselves have no function.

In order to make use of the data transmission contacts 6, a specially adapted appliance connection socket (not shown) can be provided which has contacts corresponding to the data transmission contacts 6 and thereby allows contacting by means of a female mains connection 4. In this case the appliance connection socket 4 can have blind recesses for the contact blades 10 such that only the data transmission contacts 6 alone are contacted. Alternatively hereto the appliance connection socket can also have recessed mains connection contacts for the contact blades 10, with the result that both the data transmission contacts 6 and the contact blades 10 of the mains connection for supplying electrical energy are contacted and consequently not only is the domestic appliance 2 supplied with electrical energy but a data transmission is also possible via the data transmission contacts 6. This permits, for example, programs for controlling the domestic appliance 2 to be downloaded into the controller 14 via the data transmission contacts 6 during the manufacture of a domestic appliance 2. Furthermore the data transmission contacts 6 permit a function check of the domestic appliance 2 to be performed during manufacture. Finally the data transmission contacts 6 can also be used in a fault situation to connect a diagnostic device to the controller 14 in an electrically conducting manner and thus perform a diagnosis in relation to the fault condition. It is also possible to use the data transmission contacts 6 in order to establish a connection to a communication network such as, for example, the internet by means of a modem and in this way enable a remote diagnosis to be performed in a fault situation and/or data relating, for example, to updated or new program sequences to be transferred to the domestic appliance 2.

It can additionally be provided that the data transmission contacts 6 can be covered and sealed by means of a suitable cover (not shown), e.g. made of plastic, after program data has been loaded during manufacture. This ensures that the data transmission contacts 6 are protected during shipment and operation of the domestic appliance 2 and that, for example, no conductivity bridges which could cause a malfunction in the controller 14 can be formed due to moisture. The cover (not shown) can be removed without difficulty by service personnel when necessary.

In order to allow a mains connection of the domestic appliance 2 to a domestic mains power supply without use of a socket outlet, an appliance connection socket 18 is provided which has cutouts for receiving the contact blades 10 and is embodied so as to correspond to the mains connection. Furthermore the appliance connection socket has a terminal block 20 which in the present exemplary embodiment has three terminals for the phase, the neutral conductor and the protective ground conductor. In this case the terminal block 20 has screw or other clamp-type connections in order to enable an electrically conductive connection to be established to the individual conductors of a mains connection lead 22. In order to avoid said connection being subjected to an unnecessary mechanical load, a strain relief (not shown) can also be provided.

The appliance connection socket 18 having the terminal block 20 facilitates the installation in particular at the time the appliance is first placed into operation, at which time a permanent connection to a domestic mains power supply is made for the purpose of supplying electrical energy, because the appliance connection socket 18 having the terminal block 20 permits the mains connection lead 22 to be connected to the terminal block 20 first and, after this work is completed, the appliance connection socket to be introduced into the mains connection 4. Accordingly it is not necessary, for the purposes of establishing electrical contact, to lead individual wires of the mains connection lead 22 to the region of the plinth return 8, which action necessitates a corresponding body posture. The invention therefore simplifies the mains connection and the placing of such a domestic appliance 2 into operation for the first time.

LIST OF REFERENCE SIGNS (2) Domestic appliance
(4) Mains connection
(6) Data transmission contact
(8) Plinth return
(10) Contact blade
(12) Inner surface
(14) Controller
(16) Door
(18) Appliance connection socket
(20) Terminal block
(22) Mains connection lead

The invention claimed is:

1. A domestic appliance comprising:

a treatment device structured to wash, dry, refrigerate, cook, toast, heat, mix, blend or clean domestic items; and at least one mains connection in electrical communication with the treatment device and structured to enable electrical energy to be supplied from a domestic mains power supply to the domestic appliance, wherein the mains connection includes data transmission contacts.

2. The domestic appliance as claimed in claim 1, wherein the mains connection is structured as an appliance connector.

3. The domestic appliance as claimed in claim 1, wherein the mains connection includes at least two contact blades disposed in a freestanding arrangement.

4. The domestic appliance as claimed in claim 1, wherein the mains connection is operable for providing electrical voltage levels of domestic mains power supplies.

5. The domestic appliance as claimed in claimed 1, wherein the data transmission contacts are operable at low electrical voltages.

6. The domestic appliance as claimed in claim 1, wherein the data transmission contacts are arranged on an inner surface of the mains connection.

7. The domestic appliance as claimed in claim 1, further comprising a cover for the data transmission contacts.

8. The domestic appliance as claimed in claim 1, wherein the domestic appliance comprises a refrigerator, cooking range, laundry dryer, washing machine, dishwasher, toaster, hair dryer, microwave oven, coffee machine, hand mixer, blender or vacuum cleaner.

9. The domestic appliance as claimed in claim 1, further comprising an appliance connection socket corresponding to the mains connection and having a terminal block for establishing an electrically conductive connection to a mains connection lead.

10. The domestic appliance as claimed in claim 9, further comprising a device for relieving a strain on the mains connection lead.

11. The domestic appliance as claimed in claim 9, wherein the mains connection and the appliance connection socket are detachably connected to each other.

12. The domestic appliance as claimed in claim 11, wherein the mains connection and the appliance connection socket are detachably connected to each other by a snap-in connection.

13. The domestic appliance as claimed in claim 12, wherein the snap-in connection is structured to be engaged and released without the use of tools.

14. A domestic appliance comprising:

at least one mains connection structured to enable electrical energy to be supplied from a domestic mains power supply to the domestic appliance, wherein the mains connection includes data transmission contacts; and a controller for controlling an operating sequence of the domestic appliance, wherein the controller is connected in an electrically conductive manner to the data transmission contacts.

15. The domestic appliance as claimed claim 14, wherein the data transmission contacts extend into an opening of the mains connection.

16. The domestic appliance as claimed in claim 15, wherein the controller extends at least in sections into the opening.

17. The domestic appliance as claimed in claim 15, wherein a board of the controller extends at least in sections into the opening.

18. The domestic appliance as claimed in claim 17, wherein the board of the controller forms an inner surface of the mains connection.

19. The domestic appliance as claimed in claim 17, wherein the data transmission contacts are arranged on the board of the controller.

20. A domestic appliance comprising:

at least one mains connection structured to enable electrical energy to be supplied from a domestic mains power supply to the domestic appliance, wherein the mains connection includes data transmission contacts, wherein the domestic appliance comprises a refrigerator, cooking range, laundry dryer, washing machine, dishwasher, toaster, hair dryer, microwave oven, coffee machine, hand mixer, blender or vacuum cleaner.

21. A domestic appliance comprising:

at least one mains connection structured to enable electrical energy to be supplied from a domestic mains power supply to the domestic appliance, wherein the mains connection includes data transmission contacts, wherein the domestic appliance has a plinth return.

22. The domestic appliance as claimed in claim 21, wherein the mains connection is arranged in a region of the plinth return.

* * * * *

UNITED STATES PATENT AND TRADEMARK OFFICE

CERTIFICATE OF CORRECTION

PATENT NO. : 8,382,492 B2
APPLICATION NO. : 12/743378
DATED : February 26, 2013
INVENTOR(S) : Hering et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 0 days.

Signed and Sealed this
First Day of September, 2015

Michelle K. Lee

Michelle K. Lee
*Director of the United States Patent and Trademark Office*